US005565062A

United States Patent [19]

Nass et al.

[11] Patent Number: 5,565,062

[45] Date of Patent: Oct. 15, 1996

[54] EVA POLYMERS FOR USE AS BEATER SATURANTS

[75] Inventors: David R. Nass, Bridgewater; James L. Walker, Whitehouse Station; Paul R. Mudge, Belle Mead, all of N.J.

[73] Assignee: National Starch and Chemical Investment Holding Corporation, Wilmington, Del.

[21] Appl. No.: 507,267

[22] Filed: Apr. 10, 1990

[51] Int. Cl.[6] ..... D21H 17/37

[52] U.S. Cl. ..... 162/168.1; 162/168.2; 162/168.3; 162/183

[58] Field of Search ..... 162/168.1, 169, 162/168.2, 168.3, 183

[56] References Cited

U.S. PATENT DOCUMENTS

| | | | |
|---|---|---|---|
| 3,269,860 | 8/1966 | Richardson et al. | 162/169 |
| 3,272,690 | 9/1966 | Shadan | 162/169 |
| 3,909,346 | 9/1975 | Winters | 162/155 |
| 4,032,392 | 6/1977 | Koller, Jr. | 162/155 |
| 4,188,446 | 2/1980 | Friedman | 162/168.1 |
| 4,225,383 | 9/1980 | McReynolds | 162/156 |
| 4,274,916 | 6/1981 | Grose | 162/145 |
| 4,426,470 | 1/1984 | Wessling et al. | 524/35 |
| 4,481,250 | 11/1984 | Cook et al. | 428/290 |
| 4,609,431 | 9/1986 | Grose et al. | 162/135 |
| 4,609,434 | 9/1986 | Greene et al. | 162/168 |
| 4,610,920 | 9/1986 | Mudge et al. | 428/288 |
| 4,659,595 | 4/1987 | Walker et al. | 427/391 |
| 4,666,777 | 5/1987 | Ash et al. | 428/407 |
| 4,702,957 | 10/1987 | Mudge et al. | 428/288 |
| 4,707,221 | 11/1987 | Beer et al. | 162/158 |
| 4,810,329 | 3/1989 | Camisa | 162/168 |

OTHER PUBLICATIONS

Tappi, May 1972, vol. 55, No. 5, pp. 761–768.

*Primary Examiner*—Peter Chin
*Attorney, Agent, or Firm*—Ellen T. Dec

[57] ABSTRACT

A beater saturation process for forming a nonwoven wet laid composite is provided which comprises the following steps:

(I) providing an aqueous dispersion comprising:

(a) 10 to 95% by weight of a water-dispersible, but water-insoluble fiber;

(b) 0 to 80% by weight of a finely divided, substantially water-insoluble, non-fibrous, inorganic filler;

(c) 5 to 50% by weight of an anionically charged emulsion polymer comprising 70 to 90% by weight of a vinyl ester of an alkanoic acid; 10 to 30% by weight ethylene, 0 to 70% by weight of a $C_2$–$C_8$ alkyl acrylate, and 0 to 4% by weight of an anionic functional monomer, (II) colloidally destabilizing the resulting mixture to form a fibrous agglomerate in aqueous suspension;

(III) distributing and draining the aqueous suspension on a porous substrate such as a wire to form a wet web; and (IV) drying the web.

20 Claims, No Drawings

EVA POLYMERS FOR USE AS BEATER SATURANTS

The present application is directed to novel latex binder compositions for use in the preparation of wet-laid nonwoven composites. Wet-laid nonwoven composites prepared by beater saturation processes find widespread application in such areas as flooring felts, filter media, ceramic fiber products, gasketing materials, ceiling tiles and the like.

The preparation of such wet-laid composite sheets is generally well known in the art. Beater deposition or saturation techniques are used instead of conventional saturation procedures to produce nonwoven composites, particularly in the cases where relatively thick (e.g. 10 to 60 mils) composites are to be produced since these conventional saturation techniques require saturation and subsequent drying of the already formed composite, procedures difficult to accomplish on high speed manufacturing equipment. In contrast, in accordance with beater saturation techniques, the "saturating" latex binder is combined in an aqueous dispersion with the fiber and optional filler and the resultant slurry or dispersion is destabilized with a flocculant and the wet precipitating material laid on a porous substrate to form a web using conventional paper making equipment.

Typically, the latex employed as a binder in the preparation of these wet-laid composite sheets performs two functions. The first is a wet-end function wherein the latex assists in the formation of the composite sheet into a unitary mass. The second is an end-use function wherein the physical properties of the latex contribute to the overall properties of the resultant sheet.

Wet end characteristics are important to the efficient preparation of composite sheets while end-use characteristics are important to the final properties of the composite sheet. Unfortunately, a latex which has good wet-end properties may not yield good end-use properties. Retention properties and drainage properties of the aqueous dispersion used to make the wet-laid composite must be within a range to optimize the runnability of the wet-laid composite on common papermaking equipment. However, optimization of the wet-end properties such as retention, deposition time and drainage time may result in a final product having low end-use properties such as tensile strength. On the other hand, optimization of tensile strength can lead to poor drainage time and deposition time. Therefore, it would be desirable to prepare a single latex composition having both good wet-end and end-use properties for the preparation of wet-laid composite materials.

Moreover, in considering the properties required for such latex binders, it is important to realize that in some applications such as vinyl flooring, the vinyl portion of the substrate to which the non-woven composite will be attached contains plasticizers such as dioctyl phthalate or butyl benzyl phthalate. The presence of the plasticizer generally weakens the latex in the wet-laid nonwoven composite when the plastisol is combined with the composite.

Heretofore, most wet-laid nonwoven composites have been prepared with styrene butadiene latices, however these latices tend to yellow and become brittle on aging. Additionally, some all acrylic latices have been utilized but are costly. Previous ethylene vinyl acetate latices have a cost advantage over the all acrylic systems and better aging than styrene butadiene resins, but had poor deposition/wet end properties. Other approaches to obtaining the desired balance of wet-end and end use properties have involved the addition of at least two different latices to the aqueous slurry for preparing a composite sheet; however employing more than one latex involves extra preparation, handling and storage.

SUMMARY OF THE INVENTION

We have now found that nonwoven wet-laid composites may be prepared by beater saturation processes utilizing, as the binder therefor, an anionically charged emulsion polymer comprising 70 to 90% by weight of a vinyl ester of an alkanoic acid; 10 to 30% by weight ethylene, and 0 to 4% by weight of an anionic functional monomer such as an olefinically unsaturated carboxylic acid. The anionic character of the polymer can be achieved either from the presence of an anionically charged functional monomer in the polymer backbone or from the use of an anionic surfactant in the polymerization or form a combination of the two sources. The relative amounts of the two individual components are therefore interrelated such that the anionic functional comonomers may vary generally from 0.1 to 4% by weight and the anionic surfactant from 1 to 5% with the lower levels of anionic functional monomer being used with higher levels of anionic surfactant and vice versa.

In accordance with a preferred embodiment of the invention, there is also present in the emulsion polymer up to about 70%, preferably 30 to 50%, by weight of a $C_2$–$C_8$ alkyl acrylate. The higher levels of acrylate will produce relatively low Tg polymers which are especially useful when softness is desired in the final wet laid product, while lower levels are used if a stiffer product is to be produced. The emulsion polymer may also optionally contain various pre- and post-crosslinking functional monomers. Suitable polymers use herein are disclosed, for example, in U.S. Pat. Nos. 4,610,920 and 4,659,595.

The latex polymers are readily utilized in the beater saturation process to form a nonwoven wet laid composite using the following steps:

(I) providing an aqueous dispersion comprising:

(a) 10 to 95% by weight of a water-dispersible, but water-insoluble fiber;

(b) 0 to 80% by weight of a finely divided, substantially water-insoluble, non-fibrous, inorganic filler;

(c) 5 to 50% by weight of the anionically charged emulsion polymer of the invention;

(II) colloidally destabilizing the resulting mixture with a cationic flocculant to form a fibrous agglomerate in aqueous suspension;

(III) distributing and draining the aqueous suspension on a porous substrate such as a wire to form a wet web; and (IV) drying the web.

The relative amounts of the specific components will vary substantially depending upon the wet-laid nonwoven being produced. For example in the case of wet laid felt composites to be used for vinyl flooring, the aqueous dispersion will generally comprise 12 to 18% fiber, 60 to 70% filler and 15 to 25% emulsion polymer.

DETAILED DESCRIPTION OF THE PREFERRED EMBODIMENTS

The vinyl esters utilized in the latex binders of the invention are the esters of alkanoic acids having from one to about 13 carbon atoms. Typical examples include: vinyl acetate, vinyl formate, vinyl propionate, vinyl butyrate, vinyl isobutyrate, vinyl valerate, vinyl 2-ethyl-hexanoate, vinyl isoctanoate, vinyl nonoate, vinyl decanoate, vinyl pivalate, vinyl versatate, etc. Of the foregoing, vinyl acetate is the preferred monomer because of its ready availability and low cost. The ethylene comonomer is present in amounts of 10 to 30% by weight.

Suitable anionic functional monomers which may be used include the alkenoic acids having from 3 to 6 carbon atoms or the alkenedioic acids having from 4 to 6 carbon atoms, like acrylic acid, methacrylic acid, crotonic acid, itaconic acid, maleic acid or fumaric acid; vinyl sulfonic acid and 2-acrylamido-2-methylpropane sulfonic acid or mixtures thereof. If employed, they are generally used in amounts sufficient to give between 0.1 and 4% by weight, of monomer units in the final copolymer.

In the preferred embodiment wherein alkyl acrylates are utilized, the alkyl acrylates are those containing 2 to 8 carbon atoms in the alkyl group and include ethyl, butyl, hexyl, 2-ethyl hexyl and octyl acrylate. The corresponding methacrylates may also be use herein, particularly in end use applications such as filter media, where stiffness is desirable.

Optionally, there may also be present in the latex polymer at least one conventionally employed pre- or post-crosslinking comonomers. Typical of such pre-crosslinking monomers are polyunsaturated copolymerizable monomers which may be present in small amounts, i.e., up to about 1% by weight. Such comonomers would includes those polyolefinically-unsaturated monomers copolymerizable with vinyl acetate and ethylene, such as lower alkenyl lower alkenoates, for example, vinyl crotonate, allyl acrylate, allyl methacrylate; di-lower alkenyl alkanedioates, for example, diallyl maleate, divinyl adipate, diallyl adipate; di-lower alkenyl benzene-dicarboxylates, for example, ethylene glycol diacrylate, ethylene glycol dimethacrylate, butanediol dimethacrylate; lower alkylene bis-acrylamides and lower alkylene bis-methacrylamides, for example, methylene bis-acrylamide; triallyl cyanurate, etc.

Post crosslinking comonomers are generally used at levels of 0.5 to 5% by weight, with N-methylol containing comonomers, such as N-methylol acrylamide or N-methylol methacrylamide being the most common; although other mono-olefinically unsaturated compounds containing an N-methylol groups and capable of copolymerizing with ethylene and the vinyl ester, such as N-isobutoxymethyl acrylamide, may also be employed.

As a further requirement to producing the latices of the invention, it is also necessary that the polymerization be carried out in the presence of a surfactant. When no anionic functionality is present in the polymer backbone, the polymerization must be carried out in the presence of anionic surface-active compounds. Suitable anionic emulsifiers are, for example, alkyl sulfonates, alkylaryl sulfonates, alkyl sulfates, sulfates of hydroxylalkanols, alkyl and alkylaryl disulfonates, sulfonated fatty acids, sulfates and phosphates of polyethoxylated alkanols and alkylphenols, as well as esters of sulfosuccinic acid. There may also be present small amounts of conventional non-ionic emulsifiers such as the addition products of 5 to 50 moles of ethylene oxide adducted to straight-chained and branch-chained alkanols with 6 to 22 carbon atoms, or alkylphenols, or higher fatty acids, or higher fatty amides, or primary and secondary higher alkyl amines; as well as block copolymers of propylene oxide with ethylene oxide and mixtures thereof. Preferably the emulsifiers are used in amounts of 1 to 6% by weight of the polymerisate. It is also possible to use emulsifiers alone or in mixtures with protective colloids.

In the case of polymers containing anionic functional monomers, it is possible to utilize only nonionic surfactants or protective colloids, however it is preferred to use both anionic functional monomers and anionic surfactants.

While any standard batch, semi-batch or continuous polymerization procedure can be used, in the preferred embodiment wherein alkyl acrylates are utilized, the polymerization is carried out by the semi-batch processes as described in U.S. Pat. No. 4,610,920, the disclosure of which is incorporated herein by reference.

The polymerization is carried out in a conventional monomer at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, aldehydes, chloroform, methylene chloride and trichloroethylene, can also be added in some cases. The reaction is generally continued until the residual vinyl acetate content is below about 1%. The completed reaction product is then allowed to cool to about room temperature, while sealed from the atmosphere.

Preparing the Wet Laid Composite

The wet laid nonwoven composites of the present invention are prepared using conventional beater saturation techniques. While the precise manufacturing operation and order of addition employed will vary depending upon the end use application as well as the particular manufacturer, the composites are typically prepared by making a slurry in the latex and water of the fibers, fillers, and optional components. The pH of the slurry is adjusted to from about 6 to about 12 and the flocculant added to the resultant aqueous dispersion. The aqueous dispersion is then distributed and drained on a porous substrate such as a wire to form a wet web and the web is dried.

The fillers used in the composites of the present invention are those conventionally known to one skilled in the art. Typically such fillers are finely-divided essentially water-insoluble inorganic materials such as talc, calcium carbonate, clay, titanium dioxide, amorphous silica, zinc oxide, barium sulfate, calcium sulfate, aluminum silicate, magnesium silicate, diatomaceous earth, aluminum trihydrate, magnesium carbonate, partially calcined dolomitic limestone, magnesium hydroxide and mixtures of two or more of such materials.

The filler, if present, is generally added in amounts of up about 80 weight percent based on the total dry weight of the composite. Preferably, the filler is added at an amount of from about 50 to about 70 weight percent based in the total dry weight of the composite.

The fiber is any water-insoluble, natural or synthetic water-dispersible fiber or blend of such fibers. Either long or short fibers, or mixtures thereof, are useful, but short fibers are preferred. Many of the fibers from natural materials are anionic, e.g., wood pulp. Some of the synthetic fibers are treated to make them slightly ionic, i.e., anionic or cationic. Glass fibers, chopped glass, blown glass, reclaimed waste papers, cellulose from cotton and linen rags, mineral wood, synthetic wood pulp such as is made from polyethylene, polypropylene, straws, ceramic fiber, nylon fiber, polyester fiber, and similar materials are useful. Particularly useful fibers are the cellulosic and lignocellulosic fibers commonly known as wood pulp of the various kinds from hardwood and softwood such as tone ground wood, steam-heated mechanical pulp, chemimechanical pulp, semichemical pulp and chemical pulp, specific examples are unbleaches sulfite pulp, bleached sulfite pulp, unbleached sulfate pulp and bleached sulfate pulp.

Cellulose, fiberglass, polyester, polyethylene and polypropylene are preferred fibers included in the wet laid composite of the invention. The fibers are typically included in an amount of from about 10 to about 95 weight percent based on the dry weight of the composite.

Conventional wet-strength resins may optionally be added to the composite formulation. Such a wet-strength resin can be any of the conventional wet-strength resins utilized in latex formulations such as adipic acid-diethylene triamine epichlorohydrin. The wet-strength resin, if used, is typically added in an amount of from about 0 to about 2.5 weight percent of total composite based on dry weight of composite. More preferably, the wet-strength resin is present in the felt composite in an amount of from about 0.05 to about 0.5 weight percent of total composite based on dry weight of composite. Most preferably, the wet-strength resin is present in the felt composite in an amount of about 0.25 weight percent of total composite based on dry weight of composite.

Small amounts of various other wet-end additives of the types commonly used in wet laid beater addition may also be present. Such materials include various hydrocarbon and natural waxes, cellulose derivatives such as carboxymethyl cellulose and hydroxyethyl cellulose; water-soluble organic dyestuffs, water-insoluble but water-dispersible coloring pigments such as carbon black, vat colors and sulfur colors; starch, natural gums such as guar gum and locust bean gum, particularly their anionic and cationic derivatives; non-ionic acrylamide polymers,; strength improving resins such as melamine-formaldehyde resins, urea-formaldehyde resins and curing agents, etc.

The resulting aqueous dispersion is then colloidally destablized to form a fibrous agglomerate in aqueous suspension form using a cationic flocculant. The flocculants used herein are those conventionally used in wet laid beater additions and include alum, modified cationic polyacrylamide, diallyl-dimethylammonium chloride, adipic acid-diethylene triamine—epichlorianhydrin, cationic starch, etc. The amount of flocculant required to destabilize the emulsion will vary depending on the particular flocculant used as well as the degree of anionicity in the emulsion polymer. In general, it will vary from 0.01 to 1% by weight of the total solids, preferably in amounts less than about 0.20%.

The pH of the composite slurry will vary depending on the nature and level of the filler and flocculant used as well as the order of addition of the components and will typically be from about 6 to about 12, preferably from about 8 to about 10.

Ordinarily, the filler, flocculant, water and the latex are added (usually but not necessarily in that order) to the slurry with agitation. At least some required colloidal destabilization can occur simultaneously with the mixing of the fiber, filler and latex either through interaction of the required components or through the concurrent addition of other optional wet-end additives such as those mentioned below. The mechanical shear caused by mixing and by transfer of the materials through the equipment used can cause, or assist in, the destabilization.

The temperature of the process through the step of forming the wet web usually is in the range of from about 40° F. to about 130° F. although temperatures outside those ranges can be used provided that they are above the freezing point of the aqueous dispersion and are below the temperature at which the latex polymer being used would soften unduly. Sometimes temperatures above ambient conditions promote faster drainage.

The wet laid nonwoven composite of the present invention is typically prepared by conventional methods such as on a hand-sheet-forming apparatus or common, continuous papermaking equipment such as a Fourdrinier machine, a cylinder machine, suction machines such as a Rotoformer, or on millboard equipment. Suitable also for use in the practice of this invention are other well-known modifications of such equipment, for example, a Fourdrinier machine with secondary headboxes or multicylinder machines in which, if desired, different furnishes can be used in the different cylinders to vary the composition and the properties of one or more of the several plies which can comprise a finished board.

Conventional anionic or cationic retention aids maybe added to the composite formulation just prior to the slurry being deposited on the porous substrate. Representative examples would include many of the cationic flocculants discussed above such as alum, cationic wet strength resins such as adipic acid-diethylene triamine-epichlorohydrin, or cationic polyacrylamide as well as conventional anionic retention aids.

EXAMPLE I

This example describes the semi batch preparation of the emulsion polymers utilized as a latex in wet-laid composites in accordance with the present invention.

A 10 liter stainless steel autoclave equipped with heating/cooling means, variable rate stirrer and means of metering monomers and initiators was employed. To the 10 liter autoclave was charged 450 g (of a 20% w/w solution) sodium alkyl aryl polyethylene oxide sulphate (3 moles ethylene oxide), 40 g (of a 70% w/w solution in water) alkyl aryl polyethylene oxide (30 mole ethylene oxide), 90 g sodium vinyl sulfonate (25% solution in water), 0.5 g sodium acetate, 5 g (of a 1% solution in water) ferrous sulfate solution, 2 g sodium formaldehyde sulfoxylate and 2500 g water. After purging with nitrogen all the vinyl acetate (2000 g) with 2.3 g TAC dissolved was added and the reactor was pressurized to 750 psi with ethylene and equilibrated at 50° C. for 15 minutes.

The polymerization was started by metering in a solution of 25 g. tertiary butyl hydroperoxide in 250 g of water and 20 g sodium formaldehyde sulfoxylate in 250 g water. The initiators were added at a uniform rate over a period of 5¼ hours.

Concurrently added with the initiators over a period of 4 hours was an emulsified mix of 280 g N-methylol acrylamide (48% w/w solution in water), 22.5 g of acrylic acid, 2000 g butyl acrylate, 2.2 g TAC, 100 g of sodium alkyl aryl polyethylene oxide (3 moles ethylene oxide) sulfate (20% w/w solution in water), 1.5 g of sodium acetate in 400 g of water.

During the reaction the temperature was controlled at 65° C. to 70° C. by means of jacket cooling. At the end of the reaction the emulsion was transferred to an evacuated vessel (30 L) to remove residual ethylene from the system.

Using procedures similiar to those described in Examples I, four additional emulsions were prepared. The polymeric compositions of the five emulsions are shown in Table I.

A further sample was prepared using the following batch polymerization procedure to produce an ethylene vinyl acetate polymer containing no acrylate.

A 10 liter stainless steel autoclave equipped with heating/cooling means, variable rate stirrer and means of metering monomers and initiators was employed. To the 10 liter autoclave was charged 600 g (of a 20% w/w solution) sodium alkyl aryl polyethylene oxide sulphate (3 moles ethylene oxide), 90 g (of a 70% w/w solution in water) alkyl aryl polyethylene oxide (30 mole ethylene oxide), 90 g sodium vinyl sulfonate 25% solution in water), 0.5 g sodium acetate, 5 g (of a 1% solution in water) ferrous sulfate solution, 2 g sodium formaldehyde sulfoxylate and 2000 g water. After purging with nitrogen all the vinyl acetate (4000 g) was added and the reactor was pressurized to 750 psi with ethylene and equilibrated at 50° C. for 15 minutes.

The polymerization was started by metering in a solution of 15 g. tertiary butyl hydroperoxide in 250 g of water and 15 g sodium formaldehyde sulfoxylate in 250 g water. The initiators were added at a uniform rate over a period of 5¼ hours.

Concurrently added with the initiators over a period of 4 hours was an aqueous solution of 280 g N-methylol acrylamide (48% w/w solution in water), 45 g of acrylic acid, 1.5 g of sodium acetate in 1000 g of water.

During the reaction the temperature was controlled at 70° C. to 75° C. by means of jacket cooling. At the end of the reaction the emulsion was transferred to an evacuated vessel (30 L) to remove residual ethylene from the system.

This procedure resulted in a polymeric composition of ethylene, vinyl acetate, N-methylol acrylamide and acrylic acid (E/VA/NMA/AA) in a 25:75:3:1 ratio designated Sample 6 in Table I.

TABLE I

| Sample | VA | BA | E | NMA | AA | TAC |
|---|---|---|---|---|---|---|
| 1 | 44 | 44 | 12 | 3 | 0.5 | 0.1 |
| 2 | 44 | 44 | 12 | — | 0.25 | 0.1 |
| 3* | 44 | 44 | 12 | — | — | 0.1 |
| 4 | 44 | 44 | 12 | — | 1.2 | 0.1 |
| 5 | 44 | 44 | 12 | — | 2.5 | — |
| 6 | 75 | — | 25 | 3 | 1 | — |

Key: *No sodium vinyl sulfonate was employed
VA = Vinyl acetate
BA = Butyl acrylate
E = Ethylene
NMA = N-methylol acrylamide
AA = Acrylic acid
TAC = Triallyl cyanurate
Additionally, the following controls were prepared:
Control 7 - Commercial carboxylated styrene buadiene
Control 8 - Commercial all acrylic latex containing NMA
Control 9 - Commercial all acrylic latex with no NMA The samples described in Table I as well as controls of 7–9 were formulated into slurrys and wet laid felt composites were prepared therefrom using the following formulation and precipitation procedure.

Formulation:

| Raw Material | Amount (Dry) |
|---|---|
| Unbleached Kraft/No. Softwood pulp | 4.56 |
| Talc (grade AR-Windsor Minerals) | 50.0 |
| Polyester fiber (⅛ in., 3 denier) | 2.0 |
| Kymene 557H (Hercules) | 0.324 |
| Alum | 3.9 |
| Latex | 9.75 |
| | Theoretical |
| Wt. = 67.4 | |

Precipitation Procedure

Into a beaker add, 380 mls of 1.2% consistency Kraft pulp and 1000 mls of 85° F. water. Allow this to mix 1 minute at 420 rpm, then add, talc and polyester fibers, while mixing for an addition 2 minutes. Then add the remaining ingredients in the following order: Kymene 557H, Alum, Latex.

The time it takes (in minutes) for flocculation to occur so that the latex is deposited on to the fiber and the backwater is clear is the precipitation time.

Once precipitated, the stock slurry is transferred to a 12"×12" Williams Sheet Mold that is partly filled with water. The slurry is diluted so that the total volume in the sheet mold is 15 L. The drainage time is the time (in seconds) it takes for the stock to drain from the 12"×12" handsheet mold through an 80 mesh screen. The dried weight of the handsheet divided by the theoretical weight of the handsheet times 100 is the % retention of solids in the sheet. The "Gauge" is the thickness (in inches) of the final composite. The average results of two samples run on this "wet end" testing are shown in Table II.

TABLE II

| Sample | Precipitation Time min. | Drain Time sec. | % Retention | Gauge in. |
|---|---|---|---|---|
| 1 | 0.5 | 7 | 94 | .030 |
| 2 | 0.5 | 9 | 95 | .030 |
| 3 | 3.5 | 37 | 88 | .027 |
| 4 | 4 | 51 | 62 | .023 |
| 5 | 4 | 79 | 63 | .022 |
| 6 | 0.5 | 19 | 96 | .029 |
| 7 | 4 | 134 | 72 | .026 |
| 8 | 1 | 10 | 95 | .029 |
| 9 | 0.5 | 9 | 93 | .029 |

The resultant wet laid composite was subjected to the following testing to determine the effect of the various latices on the sheet properties thereof.

Tensile properties: 1"×7" sample size, 4 inch gauge length, 5 in./min. crosshead speed testing tensile and elongation. Testing was done under the following ambient, hot and plasticized conditions:

Ambient: 70° F.

Hot: 350° F. 1"×7" sample is placed in heated chamber around Instron jaws. The sample is pulled after 1 min. dwell time.

Plasticized: 24 hour soak of samples in butyl benzyl phthalate prior to tensile testing.

Stiffness: Taber stiffness testing samples as is and after 18 hrs at 300° F. accelerated oven aging. Sample size was 1½×2¾".

Color: Technidyne Brightimeter Micro S-5 testing samples as is and after 18 hrs. at 300° F. accelerated oven aging using TAPPI procedure 452 at 457 mm. The Hunter Scale records the results following TAPPI procedure T524 cm-86. (L/A/B colority of white and near white paper and paperboard.)

The results of this dry sheet testing is presented in Tables III and IV.

TABLE III

| | AMBIENT | | PLASTICIZED | | HOT 350° F. | | | |
|---|---|---|---|---|---|---|---|---|
| | Peak Load | % Elong. | Peak Load | % Elong. | Peak Load | % Elong. | INITIAL AGED | |
| Sample | lbs. | % | lbs. | % | lbs. | % | Taber | Stiffness |
| 1 | 15.9 | 4.9 | 5.8 | 2.6 | 6.9 | 2.7 | 23 | 57 |
| 2 | 14.6 | 4.8 | 3.7 | 2.7 | 5.3 | 2.4 | 14 | 38 |
| 3 | 17.8 | 5.0 | 3.0 | 2.1 | 3.8 | 2.1 | 16 | 37 |
| 4 | 24.5 | 5.1 | 5.4 | 2.6 | 6.2 | 2.4 | 16 | 60 |
| 5 | 29.7 | 6.0 | 6.3 | 2.7 | 6.4 | 2.3 | N/T | N/T |
| 6 | 20.5 | 4.25 | 6.1 | 2.3 | 6.8 | 2.3 | 12 | 37 |
| 7 | 16.2 | 3.6 | 7.8 | 2.9 | 8.3 | 2.4 | 17 | 112 |
| 8 | 24.8 | 5.6 | 8.5 | 3.1 | 8.6 | 3.0 | 18 | 32 |
| 9 | 19.6 | 6.2 | 4.2 | 3.7 | 5.1 | 2.5 | 17 | 29 |

(Data has been normalized to 70 lb./480 $ft^2$ basis wt.

TABLE IV

| | Color | Evaluation Hunter* | | Initial | | Color Evaluation Hunter* | | Aged |
|---|---|---|---|---|---|---|---|---|
| Sample | L | a | b | Brightness | L | a | b | Brightness |
| 1 | 75.5 | 0.7 | 8.0 | 48.9 | 68.0 | 1.7 | 18.1 | 29.3 |
| 2 | 75.4 | 0.7 | 8.0 | 49.0 | 67.2 | 1.9 | 18.5 | 28.0 |
| 3 | 74.9 | 0.7 | 8.3 | 47.6 | 68.7 | 1.3 | 17.8 | 30.3 |
| 4 | 75.0 | 0.7 | 8.6 | 47.4 | 63.8 | 2.9 | 19.6 | 23.3 |
| 5 | 76.1 | 0.5 | 8.4 | 49.1 | 65.3 | 2.6 | 19.1 | 25.2 |
| 6 | 74.6 | 0.4 | 8.6 | 47.1 | 67.1 | 2.1 | 18.6 | 28.6 |
| 7 | 76.2 | 0.4 | 8.4 | 49.2 | 58.1 | 5.4 | 18.9 | 18.4 |
| 8 | 74.5 | 1.3 | 8.5 | 47.0 | 70.2 | 1.3 | 15.3 | 34.5 |
| 9 | 75.0 | 1.0 | 8.0 | 48.0 | 68.9 | 1.5 | 16.7 | 31.6 |

*Hunter Scale
L = "Lightness" O (black)–100 (white)
a = 60 (red) 0 (grey)–50 (green)
b = 60 (yellow) 0 grey)–80 (blue)

We claim:

1. A beater saturation process for forming a nonwoven wet laid composite comprising the following steps:

(I) providing an aqueous dispersion comprising:

(a) 10 to 95% by weight of a water-dispersible, but water-insoluble fiber;

(b) 0 to 80% by weight of a finely divided, substantially water-insoluble, non-fibrous, inorganic filler;

(c) 5 to 50% by weight of an anionically charged emulsion polymer comprising 70 to 90% by weight of a vinyl ester of an alkanoic acid 10 to 30% by weight ethylene, 0 to 70% by weight of a $C_2$–$C_8$ alkyl acrylate, and 0 to 4% by weight of an anionic functional monomer, (II) colloidally destabilizing the resulting mixture with a cationic flocculant to form a fibrous agglomerate in aqueous suspension;

(III) distributing and draining the aqueous suspension on a porous substrate to form a wet web; and (IV) drying the web.

2. The process of claim 1 wherein the anionic character of the emulsion polymer is provided by the presence of 0.1 to 4% by weight of an anionic functional monomer.

3. The process of claim 1 wherein the anionic functional monomer is an olefinically unsaturated carboxylic acid.

4. The process of claim 1 wherein the anionic character of the emulsion polymer is provided by the presence of an anionic surfactant.

5. The process of claim 1 wherein the anionic character of the emulsion is provided by the presence of both an anionic functional monomer and an anionic surfactant.

6. The process of claim 1 wherein there is additionally present in the anionic emulsion polymer 30 to 50% by weight of a $C_2$–$C_8$ alkyl acrylate.

7. The process of claim 1 wherein there is additionally present in the emulsion polymer up to 1% by weight of a polyolefinically unsaturated copolymerizable comonomer.

8. The process of claim 7 wherein the polyolefinically-unsaturated copolymerizable comonomer is selected from the group consisting of vinyl crotonate, allyl acrylate, allyl methacrylate, diallyl maleate, divinyl adipate, diallyl adipate, diallyl phthatlate; lower alkanediol diethylene glycol diacrylate, ethylene glycol dimethacrylate, butanediol dimethacrylate; methylene bis-acrylamide and triallyl cyanurate.

9. The process of claim 1 wherein there is additionally present in the anionic emulsion polymer 0.5 to 5% by weight of an N-methylol containing comonomer.

10. The process of claim 1 wherein the wet laid composite comprises 12 to 18% by weight fiber, 60 to 70% by weight filler and 15 to 25% by weight emulsion polymer.

11. A nonwoven wet laid composite comprising:

(a) 10 to 95% by weight of a water-dispersible, but water-insoluble fiber;

(b) 0 to 80% by weight of a finely divided, substantially water-insoluble, non-fibrous, inorganic filler; and (c) 5 to 50% by weight of an anionically charged emulsion polymer comprising 70 to 90% by weight of a vinyl ester of an alkanoic acid 10 to 30% by weight ethylene, 0 to 70% by weight of a C2–C8 alkyl acrylate, and 0 to 4% by weight of an anionic functional monomer, said composite being produced by beater saturation techniques wherein an aqueous dispersion of (a), (b) and (c) are colloidally destabilized with a cationic flocculant to form a fibrous agglomerate in aqueous suspension; the aqueous suspension is distributed and drained on a porous substrate to form a wet web; and the resulting web dried.

12. The composite of claim 11 wherein the anionic character of the emulsion polymer is provided by the presence of 0.1 to 4% by weight of an anionic functional monomer.

13. The composite of claim 11 wherein the anionic character of the emulsion polymer is provided by the presence of an anionic surfactant.

14. The composite of claim 11 wherein the anionic character of the emulsion is provide by the presence of both an anionic functional monomer and an anionic surfactant.

15. The composite of claim 11 wherein there is additionally present in the anionic emulsion polymer 30 to 50% by weight of a $C_2$–$C_8$ alkyl acrylate.

16. The composite of claim 11 wherein there is additionally present in the emulsion polymer up to 1% by weight of a polyolefinically unsaturated copolymerizable monomer selected from the group consisting of vinyl crotonate, allyl acrylate, allyl methacrylate, diallyl maleate, divinyl adipate, diallyl adipate, diallyl phthatlate; lower alkanediol diethylene glycol diacrylate, ethylene glycol dimethacrylate, butanediol dimethacrylate; methylene bis-acrylamide and triallyl cyanurate.

17. The composite of claim 11 wherein there is additionally present in the anionic emulsion polymer 0.5 to 5% by weight of an N-methylol containing comonomer.

18. The composite of claim 11 comprising 12 to 18% by weight fiber, 60 to 70% by weight filler and 15 to 25% by weight emulsion polymer.

19. The composite of claim 11 wherein the fiber is selected from the class consisting of cellulose, fiberglass, polyester, polyethylene and polypropylene.

20. The composite of claim 11 containing filler selected from the group consisting of talc, calcium carbonate, clay, titanium dioxide, amorphous silica, zinc oxide, barium sulfate, calcium sulfate, aluminum silicate, magnesium silicate, diatomaceous earth, aluminum trihydrate,magnesium carbonate, partially calcined dolomitic limestone, magnesium hydroxide and mixtures thereof.

* * * * *